United States Patent [19]

Lehman et al.

[11] Patent Number: 4,982,233

[45] Date of Patent: Jan. 1, 1991

[54] METHOD AND APPARATUS FOR SENSING CONTAMINATION WITHIN AN OPTICAL SCANNING SYSTEM

[75] Inventors: Richard F. Lehman, Webster; James D. Rees, Pittsford, both of N.Y.

[73] Assignee: Xerox Corporation, Stamford, Conn.

[21] Appl. No.: 433,249

[22] Filed: Nov. 8, 1989

[51] Int. Cl.[5] ..... G03G 21/00

[52] U.S. Cl. ..... 355/209; 355/204; 355/215

[58] Field of Search ..... 355/203, 204, 206, 209, 355/215; 356/357, 380

[56] References Cited

U.S. PATENT DOCUMENTS

| | | | |
|---|---|---|---|
| 4,555,621 | 11/1985 | Buchar | 250/205 |
| 4,811,114 | 5/1989 | Yamamoto et al. | 358/51 X |
| 4,815,842 | 3/1989 | Flint et al. | 356/328 X |
| 4,841,337 | 6/1989 | Hiratsuki et al. | 355/246 X |

FOREIGN PATENT DOCUMENTS

| | | | |
|---|---|---|---|
| 0017371 | 10/1980 | European Pat. Off. | 356/239 |
| 0200342 | 9/1987 | Japan | 355/203 |
| 0263877 | 10/1988 | Japan . | |

*Primary Examiner*—A. T. Grimley
*Assistant Examiner*—J. E. Barlow, Jr.

[57] ABSTRACT

A sensor array is positioned in the optical scanning system of a copier so as to be able to periodically provide a measurement of the degree of image degradation present in the system due to contamination of the optical system components. The sensor array is adapted to measure the modulation transfer frequency of a bar chart which is exposed in the optical system. The measured value of MTF is compared to a predetermined value of MTF representing a uncontaminated measurement at the bar chart. When the comparison indicates that the measured MTF is below a minimum acceptable threshold value, a display is activated to alert an operator that an optic system cleaning operation is required.

7 Claims, 2 Drawing Sheets

METHOD AND APPARATUS FOR SENSING CONTAMINATION WITHIN AN OPTICAL SCANNING SYSTEM

BACKGROUND AND INFORMATION DISCLOSURE STATEMENT

The present invention relates to optical systems used in an electrophotographic reproduction device for exposing an original document on a document platen and, more particularly, to an apparatus for sensing the amount of contamination present in the optical system.

In an electrostatographic reproducing apparatus of the type commonly in use today, a photoconductive insulating member is charged to a uniform potential and thereafter exposed to a light image of an original document to be reproduced. The exposure selectively discharges the photoconductive insulating surface and creates an electrostatic latent image on the member which corresponds to the image areas contained within the original document. Subsequently, the electrostatic latent image on the photoconductive insulating surface is made visible by developing the image with a developing powder, referred to in the art as toner. Most development systems employ a developer material which comprises both charged carrier particles and charged toner particles which triboelectrically adhere to the carrier particles. During development, the toner particles are attracted from the carrier particles by the charge pattern of the image areas on the photoconductive insulating surface to form a powder image. This image may subsequently be transferred to a support surface such as copy paper to which it may be permanently affixed by heating or by the application of pressure. Following transfer of the toner image to the support surface, the photoconductive insulating surface is cleaned of residual toner to prepare it for the next imaging cycle.

One of the problems associated with these prior art reproduction machines is contamination of the various processing stations by charged toner particles, paper particles, dust particles and the like. These particles may be attracted to critical surfaces of the various processing stations, resulting in contamination and degradation of the performance of that subsystem. To maintain copy quality, it is essential that the elements of the automatic reproducing machine remain substantially free from contaminating particles. One of the areas which is most sensitive to contamination is the optical system. If toner or dust is allowed to collect on a lens or a mirror, for example, the exposure is reduced by light that is scattered out of the optical path causing copy background and, further, image modulation is reduced by the same phenomenon of light being scattered into the image foreground areas. Either factor results in a loss of low contrast copy ability.

It is known in the art to use a photosensor to sense the presence of a buildup in optical system contamination. The sensors are typically used to measure a change in one of the following parameters: reflectance of a mirror; transmittance of a transparent material on the light scattering surface, or transmission of a lens. A feedback control system is usually implemented to increase the illumination source output to correct the exposure. U.S. Pat. No. 4,555,621, is illustrative of such prior art sensing systems.

These prior art sensing and control systems have several disadvantages. Both photosensor and illumination light sources are subject to long term sensitivity/emission variations. When a correction occurs, the signal change cannot be differentiated from a signal change attributable to contamination sensing. Thus, when a correction signal is generated by the sensing/control system, it is not always certain that the sensed correction condition is actually due to increased contamination in the system or to the variation in the sensing/control system. Thus, an unnecessary cleaning procedure may be initiated which, furthermore, sometimes results in inadvertent damage to other system components. Another disadvantage is that the illumination exposure control circuit, while restoring the correct exposure does not improve the contrast degradation caused by the contamination. In fact, contrast degradation, as will be described below, can only be corrected by cleaning the optical elements and the need for improvement is a determination of an optimum time doing so.

The present invention is, therefore, directed to a contamination sensing system which is not susceptible to drift variations in the sensing components, to lamp drift or other conditions not directly related to the actual contamination present in the system. The present sensing system is designed to generate a correction signal only when contamination reduces image modulation as expressed by an MTF value below a previously set minimum value. This sensing system includes a low resolution sensor array such as a CCD array to measure image modulation at some point along the optical path. This is done by sensing a bar target of known resolution which is placed on the document platen. More particularly, this invention relates to an electrophotographic reproduction machine including imaging means for forming a latent image of a document located in an object plane, at a photoreceptor surface, the imaging means including means for illuminating the document and means for projecting the document image onto said photoreceptor surface, the improvement comprising the combination of a linear sensor array positioned along the optical path, said sensor array adapted to read a bar chart located in the object plane and to generate output signals representative of said bar chart maximum and minimum values, a comparison/memory circuit which receives the output signals from said sensor array and computes the value of the modulation transfer function MTF, said circuit containing nonvolatile memory with a predetermined value representing a minimum MTF value stored therein, said memory adapted to compare the previously stored MTF value with the computed value, and output means connected to said comparison/memory circuit, said output means actuated to provide an indication of when the measured MTF falls below the predetermined minimum MTF value.

DESCRIPTION OF THE INVENTION

Figure 1:
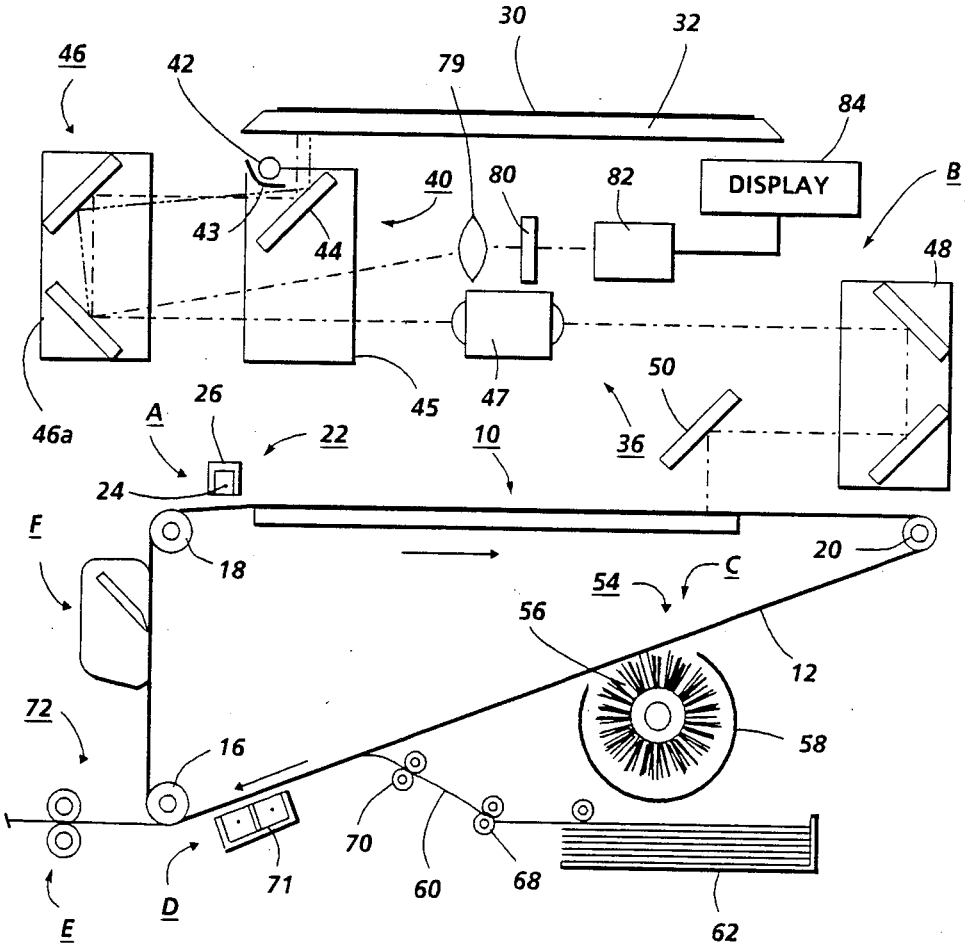
FIG. 1 is a schematic side view showing an electrophotographic reproduction machine incorporating the contamination sensing system of the present invention.

FIG. 1 schematically depicts the various components of an illustrative electrophotographic reproduction machine incorporating the contamination-sensing device of the present invention therein. It will become apparent from the following discussion that this sensing device is equally well suited for use in a wide variety of electrophotographic reproduction machines and is not necessarily limited in its application to the particular embodiment shown herein.

Inasmuch as the art of electrophotographic reproduction is well known, the various processing stations employed in the FIG. 1 printing machine will be shown hereinafter schematically and their operation described briefly with reference thereto.

Turning now to FIG. 1, an electrophotographic reproduction machine uses a photoreceptor belt 10 having a photoconductive surface 12 formed on a conductive substrate. Belt 10 moves in the indicated direction, advancing sequentially through the various xerographic process stations. The belt is entrained about drive roller 18 and tension rollers 16, 20. Roller 18 is driven by conventional motor means, not shown.

With continued reference to FIG. 1, a portion of belt 10 passes through charging station A where a corona generating device, indicated generally by the reference numeral 22, charges photoconductive surface 12 to a relatively high, substantially uniform, negative potential. Device 22 comprises a charging electrode 24 and a conductive shield 26.

As belt 10 continues to advance, the charged portion of surface 12 moves into exposure station B. An original document 30 is positioned, on the surface of a transparent platen 32. Optics assembly 36 contains the optical components which incrementally scan-illuminate the document from left to right and projects a reflected image onto surface 12 of belt 10 forming a latent image thereon. Shown schematically, these optical components comprise an illumination scan assembly 40, comprising illumination lamp 42, associated reflector 43 and full rate scan mirror 44, all three components mounted on a scan carriage 45. The carriage ends are adapted to ride along guide rails (not shown) so as to travel along a path parallel to and beneath, the platen. Lamp 42 illuminates an incremental line portion of document 30. The reflected image is reflected by scan mirror 44 to corner mirror assembly 46 mounted on a second scan carriage 46A. Scan carriage 46A is mechanically connected to carriage 45 and adapted to move at ½ the rate of carriage 45. The document image is projected through lens 47 and reflected by a second corner mirror assembly 48 and by belt mirror 50, onto surface 12 to form thereon an electrostatic latent image corresponding to the informational areas contained within original document 30.

At development station C, a magnetic brush development system, indicated generally by the reference numeral 54, advances an insulating development material into contact with the electrostatic latent image. Preferably, magnetic brush development system 54 includes a developer roller 56 within a housing 58. Roller 56 transports a brush of developer material comprising magnetic carrier granules and toner particles into contact with belt 10. Roller 56 is positioned so that the brush of developer material deforms belt 10 in an arc with the belt conforming, at least partially, to the configuration of the developer material. The thickness of the layer of developer material adhering to developer roller 56 is adjustable. The electrostatic latent image attracts the toner particles from the carrier granules forming a toner powder image on photoconductive surface 12.

Continuing with the system description, an output copy sheet 60 taken from a supply tray 62 is moved into contact with the toner powder image at transfer station D. The support material is conveyed to station D by a pair of feed rollers 68, 70. Transfer station D includes a corona generating device 71 which sprays ions onto the backside of sheet 60, thereby attracting the toner powder image from surface 12 to sheet 60. After transfer, the sheet advances to fusing station E where a fusing roller assembly 72 affixes the transferred powder image. After fusing, sheet 60 advances to an output tray (not shown) for subsequent removal by the operator. After the sheet of support material is separated from belt 10, the residual toner particles and the toner particles of developed test patch areas are removed at cleaning station F.

Subsequent to cleaning, a discharge lamp, not shown, floods surface 12 with light to dissipate any residual charge remaining thereon prior to the charging thereof for the next imaging cycle.

It is understood that the optical elements discussed above (mirrors, lens, platen) are contained within an optical light housing which is susceptible to the types of contamination discussed above. For example, toner particles may enter the housing and settle on mirrors 44, 46, 48 or 50, or on either face of lens 47. This contamination, if not periodically removed or cleaned, will reach a critical level at which the image contrast at the photoreceptor will be degraded to the point where unacceptable output copies are generated. According to a first aspect of the present invention, a low resolution sensor array, for this embodiment linear CCD array 80, is positioned at a selected point along the optical path and is adapted to sense or read a bar chart which is placed on platen 32 and exposed. The bar chart may be, for example, a special tech rep document. The sensor array "reads" the bar chart image sending signals representative of the image to a comparison/memory circuit 82. Circuit 82 computes image modulation expressed by the formula $$MTF = \left( \frac{\text{Max} - \text{Min}}{\text{Max} + \text{Min}} \right) \quad (1)$$

The computed value is compared in nonvolatile memory to a contrast level measured in the factory when the the optical components were cleaned (the initialization procedure would require a measurement of the same type of test target used by the field technician). The threshold is computed by multiplying the measured maximum MTF by some acceptable degradation factor, e.g., 0.9. Thus, any measured MTF greater than 90% of the original contrast would be acceptable, but a measured MTF below the level would cause an output signal to be sent to a display 84 signifying the need for cleaning of the optical components.

Figure 2:
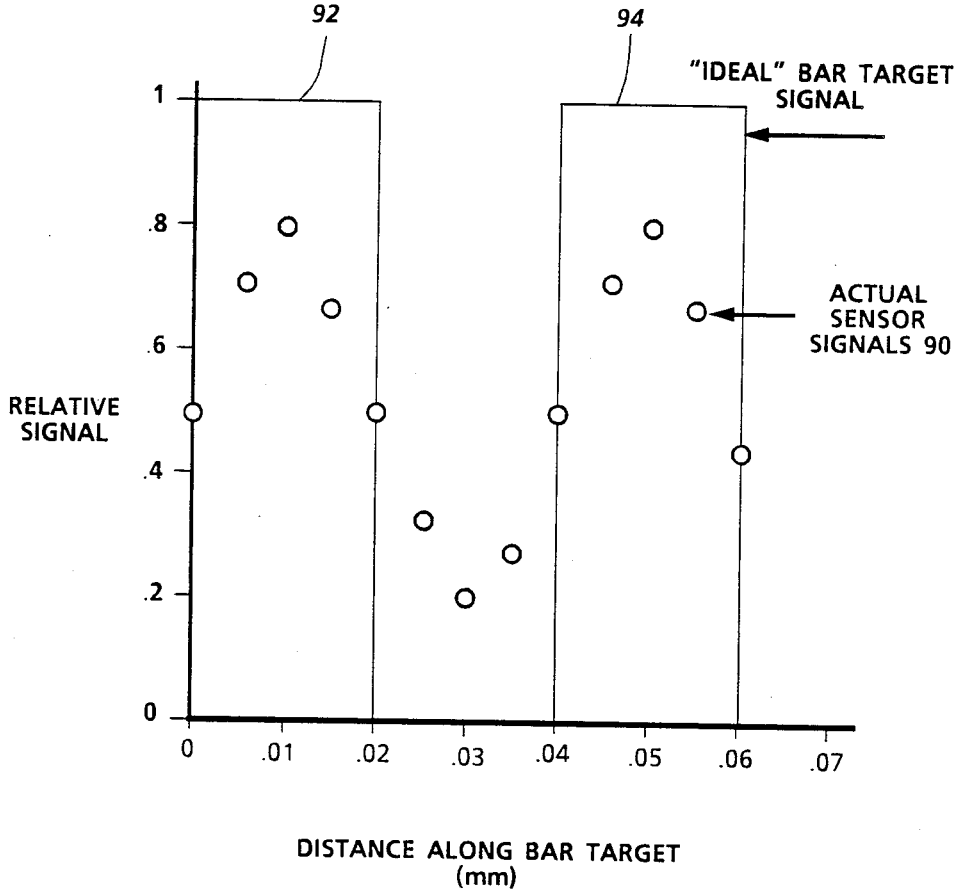
FIG. 2 is a plot of sensor array measurements along a portion of a target bar chart.

In the first embodiment of the invention an array 80 which can be a full width low resolution (100 SPI) CCD array, is positioned in the optical path adjacent the lens 47. At this position array 80 will measure light reflected from the bar chart and focused onto the array by lens 79. The bar chart has as one example, a series of alternating black bars at frequency of 1–4 line pairs per millimeter. The array reads the bar chart and generates the signals representing the image modulation. FIG. 2 shows a plot of relative signals viewed along a portion of the bar chart. Actual pixel measurements 90 are shown superimposed on two bar lines 92, 94 and the spacing therebetween. For the example shown, the MTF, using equivalent (1) is $$MTF = \frac{.8 - .2}{.8 + .2} = 60\%$$

A signal representing this value is compared in memory unit 82 with a predetermined signal representing the minimum MTF value below which the output image would be unacceptably degraded. For this example then, memory 82 would determine that the MTF measurements of the RIS would be below the acceptable threshold and a signal would be sent to activate display 84 providing a visual warning to clean the optics.

It is apparent that, by basing the cleaning step on measuring and comparing system MTF, the disadvantages of the prior art are avoided. Thus, variations in the sensing or illumination system are no longer a factor and modulation losses due to system contamination are determinative of corrective action.

Figure 3:
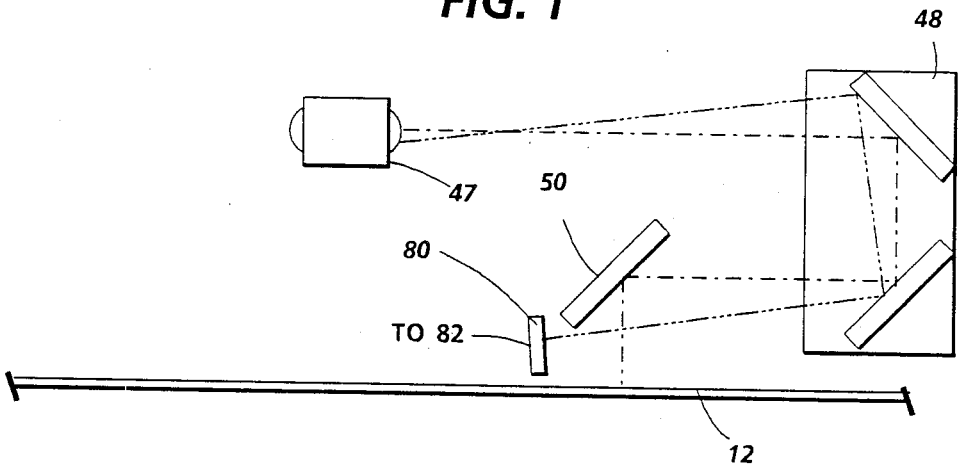
FIG. 3 demonstrates a second location for the sensing system of the present invention.

One possible disadvantage of the position of array 80, as shown in FIG. 1, is that the array will not be sensing contamination of the image side components, e.g., the lens 47, mirror 48 and mirror 50. In some systems, contamination may be greater on those components physically located closer to, for example, the toner development station. Accordingly, in a second embodiment of the invention shown in FIG. 3, the array 80 is positioned at a point beyond and below belt mirror 50 and at the same focal point as the image point at the surface of belt 12.

While the invention has been disclosed in the context of a scanning type of optical system, it may be practiced in a flash-type system as well. For this case, the CCD array is positioned in the image plane and the bar chart image is flash-imaged onto the array.

While the invention has been described to the structure disclosed, it is not confined to the specific details set forth, but is intended to cover such modifications or changes as may come within the scope of the following claims:

What is claimed is:

1. In an electro photographic reproduction machine including imaging means for forming a latent image of a document located in an object plane, at a photoreceptor surface, the imaging means including means for illuminating the document and the means for projecting the document image onto said photoreceptor surface, the improvement comprising an optical contamination sensing system including:

a linear sensor array positioned along the optical path, said sensor array adapted to read a bar chart located in the object plane and to generate output signals representative of said bar chart maximum and minimum values, a comparison/memory circuit which receives the output signals from said sensor array and computes the value of the modulation transfer function MTF, said circuit containing a nonvolatile memory with a predetermined value representing a value which is a percentage of the MTF obtained by reading the bar chart in an initially uncontaminated system stored therein, said memory adapted to compare the previously stored MTF value with the computed value, and display means connected to said comparison/memory circuit, said display means actuated to provide an indication that the measured MTF has fallen below the predetermined minimum MTF value, thereby signifying that the optical system should be cleaned.

2. The machine of claim 1 in which the sensor array is positioned along the optical path at a location adjacent said projecting means.

3. The machine of claim 1, wherein said sensor array is positioned adjacent said projecting means.

4. The machine of claim 1 wherein said sensor array is positioned on the image side of said projecting means.

5. The machine of claim 1 wherein the imaging means includes means for incrementally scanning and illuminating the document.

6. The machine of claim 1, wherein the imaging means includes means for flash illuminating the document, and wherein the sensor array is located adjacent the photoreceptive surface.

7. The machine of claim 1, wherein said MTF value is expressed by the formula $$MTF = \left(\frac{\text{Max} - \text{Min}}{\text{Max} + \text{Min}}\right) \quad (1)$$

wherein the max and min values are the values represented by the sensor array output signal generated while reading said bar chart image.

* * * * *